US007625062B2

(12) United States Patent
Jung et al.

(10) Patent No.: US 7,625,062 B2
(45) Date of Patent: Dec. 1, 2009

(54) INKJET IMAGE FORMING APPARATUS

(75) Inventors: Youn-gun Jung, Gunpo-si (KR); Dong-woo Ha, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 587 days.

(21) Appl. No.: 11/535,614

(22) Filed: Sep. 27, 2006

(65) Prior Publication Data

US 2007/0146417 A1 Jun. 28, 2007

(30) Foreign Application Priority Data

Dec. 28, 2005 (KR) ..... 10-2005-0131909

(51) Int. Cl.
*B41J 2/165* (2006.01)

(52) U.S. Cl. ..... 347/36; 347/35

(58) Field of Classification Search ..... 347/29–35
See application file for complete search history.

(56) References Cited

FOREIGN PATENT DOCUMENTS

| | | |
|---|---|---|
| JP | 03-193461 | 8/1991 |
| JP | 2000-334981 | 12/2000 |
| JP | 2002-19149 | 1/2002 |
| JP | 2004-90447 | 3/2004 |

*Primary Examiner*—Shih-Wen Hsieh
(74) *Attorney, Agent, or Firm*—Stanzione & Kim LLP

(57) ABSTRACT

An inkjet image forming apparatus including an inkjet head including a nozzle portion having a length in a main scanning direction that is at least the same as a width of a paper to be fed therein, a platen to move between a printing position facing the nozzle portion and to support a rear surface of paper and a maintenance position that is apart from the printing position in a sub-scanning direction, and including a receiving portion to receive waste ink, a waste ink container, and a pumping unit to operate by linking with a moving operation of the platen to pump the waste ink from the receiving portion to the waste ink container.

16 Claims, 12 Drawing Sheets

INKJET IMAGE FORMING APPARATUS

CROSS-REFERENCE TO RELATED APPLICATIONS

This application claims the benefit of Korean Patent Application No. 10-2005-0131909, filed on Dec. 28, 2005, in the Korean Intellectual Property Office, the disclosure of which is incorporated herein in its entirety by reference.

BACKGROUND OF THE INVENTION

1. Field of the Invention

The present general inventive concept relates to an inkjet image forming apparatus, and more particularly, to an inkjet image forming apparatus including an array type inkjet head.

2. Description of the Related Art

In general, inkjet image forming apparatuses are apparatuses that form images by injecting ink onto sheets of paper conveyed in a sub-scanning direction from an inkjet head, which reciprocates in a main scanning direction (shuttle type inkjet head). Recently, the printing operation is also being performed at a high speed using an inkjet head (array inkjet head) including a nozzle portion having a length of a main scanning direction corresponding to a width of the paper instead of using the shuttle type inkjet head. In the inkjet image forming apparatus, the inkjet head is fixed, and the sheets of paper are conveyed in a sub-scanning direction. Therefore, a driving unit for the inkjet image forming apparatus has a simple structure, and the printing operation can be performed at a high speed.

The inkjet head includes a nozzle portion including a plurality of nozzles, through which ink is injected. When the nozzle portion is exposed to air during a time in which the printing operation is not performed, humidity in the ink is evaporated and the viscosity of the ink increases. Also when the nozzle is not being used to perform the printing operation, humidity in the ink is evaporated and viscosity of the ink increases. Therefore, a defective injecting operation may occur due to the ink having a high viscosity. Thus, a preliminary spitting operation is performed in order to remove the ink having high viscosity.

However, in the array type inkjet head, thousands of nozzles are formed, and thus, a large amount of ink is preliminarily spitted. Therefore, the waste ink from the spitting should be pumped into a waste ink container.

SUMMARY OF THE INVENTION

The present general inventive concept provides an inkjet image forming apparatus including an array inkjet head and pumping waste ink that is preliminarily spitted into a waste ink container.

Additional aspects and advantages of the present general inventive concept will be set forth in part in the description which follows and, in part, will be obvious from the description, or may be learned by practice of the general inventive concept.

The foregoing and/or other aspects and utilities of the present general inventive concept are achieved by providing an inkjet image forming apparatus including: an inkjet head including a nozzle portion having a length in a main scanning direction that is at least the same as a width of paper being fed; a platen that moves between a printing position facing the nozzle portion and supports a rear surface of the paper and a maintenance position that is apart from the printing position in a sub-scanning direction, and including a receiving portion to receive waste ink; a waste ink container; and a pumping unit to operate by linking with a moving operation of the platen to pump the waste ink from the receiving portion to the waste ink container.

The pumping unit may include a waste ink tube to connect the receiving portion to the waste ink container, and a pressing member installed on the platen, wherein the pressing member moves while pushing the waste ink tube when the platen moves to pump the waste ink to the waste ink container. The inkjet image forming apparatus may further include: a pumping trace to guide the pressing member to push the waste ink tube during one of a process of moving the platen from the printing position to the maintenance position and a process of moving the platen in an opposite direction, and to guide the pressing member to release the pressure applied onto the waste ink tube during the other process. The pressing member may be formed as a roller and is installed on the platen to be rotatable. The pumping unit may further include: a supporting member to face the pressing member and to support the waste ink tube; and an elastic member to elastically support the supporting member.

The pumping unit may pump the waste ink when the platen moves from the printing position to the maintenance position. The pumping unit may include: a pressing roller installed on the platen; and a pumping trace, which is a slot installed on the platen to rotatably support the pressing roller, including a first end portion to guide the pressing roller to push the waste ink tube when the platen moves from the printing position to the maintenance position, and a second end portion to guide the pressing roller to release the pressure applied onto the waste ink tube when the platen moves to the printing position. The pumping unit may further include: a supporting member to support the waste ink tube; and an elastic member to elastically support the supporting member.

The foregoing and/or other aspects and utilities of the present general inventive concept are also achieved by providing an inkjet image forming apparatus, including an inkjet head to eject ink onto an image recording medium during a printing operation and to eject ink to clean nozzles of the inkjet head during a maintenance operation, the inkjet head being at least as wide as a width of the image recording medium, a platen movably disposed below the inkjet head to support the image recording medium when ink is being ejected thereon, the platen being movable between a printing position facing the inkjet head and a maintenance position disposed away from the inkjet head, the platen including a wiping unit to wipe the inkjet head when the platen is being moved between the maintenance position and the printing position and an ink receiving portion to receive access ink not ejected onto the image recording medium; and a pumping unit to pump ink out of the ink receiving portion, the pumping unit including a waste ink tube extending to the ink receiving portion and a pressing device to press the waste ink tube to force ink to the pumping unit and away from the ink receiving portion when the platen is being moved between the printing position and the maintenance position.

The foregoing and/or other aspects and utilities of the present general inventive concept are also achieved by providing a movable platen usable with an inkjet image forming apparatus, including protrusions extending from opposite sides thereof to engage with guide grooves formed in walls of the image forming apparatus to allow the platen to move between a printing position facing nozzles of an inkjet head and a maintenance position, an ink receiving portion to receive excess ink and/or spitted ink from nozzles of the inkjet, an ink waste tube extending from the ink receiving portion to an ink waste region, and a roller member extending from a portion of the platen to apply a rolling pressure to the ink waste tube when the platen moves from the printing position to the maintenance position to create a pumping action on the ink waste tube to pump the ink from the ink receiving portion to the waste region.

The movable platen may also include a pair of supporting portions each containing a pumping trace in which end portions of the roller member are guided therein to guide the roller member to guide the roller member to press against the ink waste tube and move away from the ink waste tube.

The foregoing and/or other aspects and utilities of the present general inventive concept are also achieved by providing a method of collecting waste ink from an inkjet image forming apparatus, including catching ink spitted from an inkjet head into an ink receiving portion of a platen when cleaning nozzles of the inkjet head eject ink, and pressing a tube connected between the ink receiving portion and a waste ink container with a member of the platen when moving the platen between the a printing position and a maintenance position to create a pumping force to move the ink from the ink receiving portion to the waste ink container.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
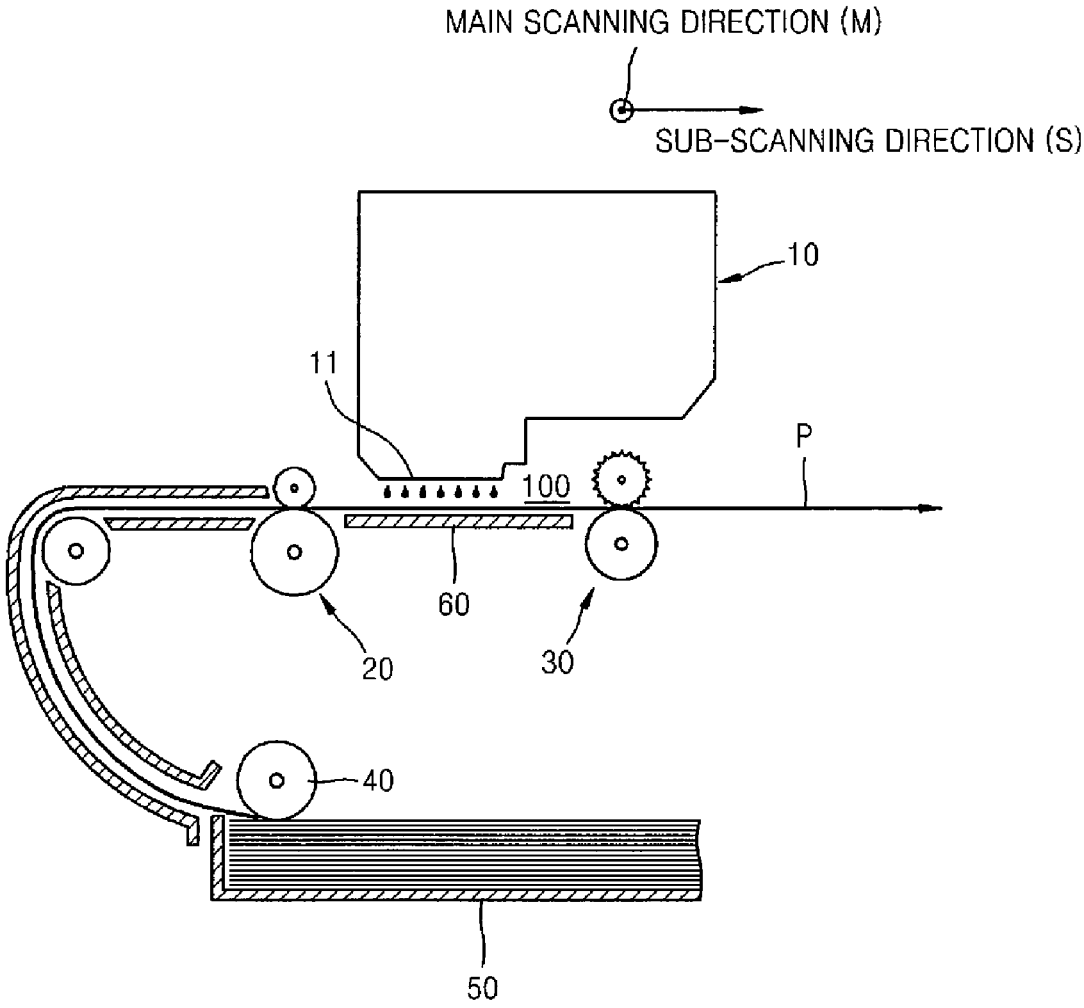
FIG. 1 is a block diagram of an inkjet image forming apparatus according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 is a block diagram of an inkjet image forming apparatus according to an embodiment of the present general inventive concept. Referring to FIG. 1, a sheet of paper (P) is picked up from a paper cassette 50 by a pickup roller 40 and conveyed in a sub-scanning direction (S) by a conveying unit 20. An inkjet head 10 is installed above the paper (P). The inkjet head 10 ejects ink onto the paper P at a fixed position to print an image on the paper P.

Figure 2:
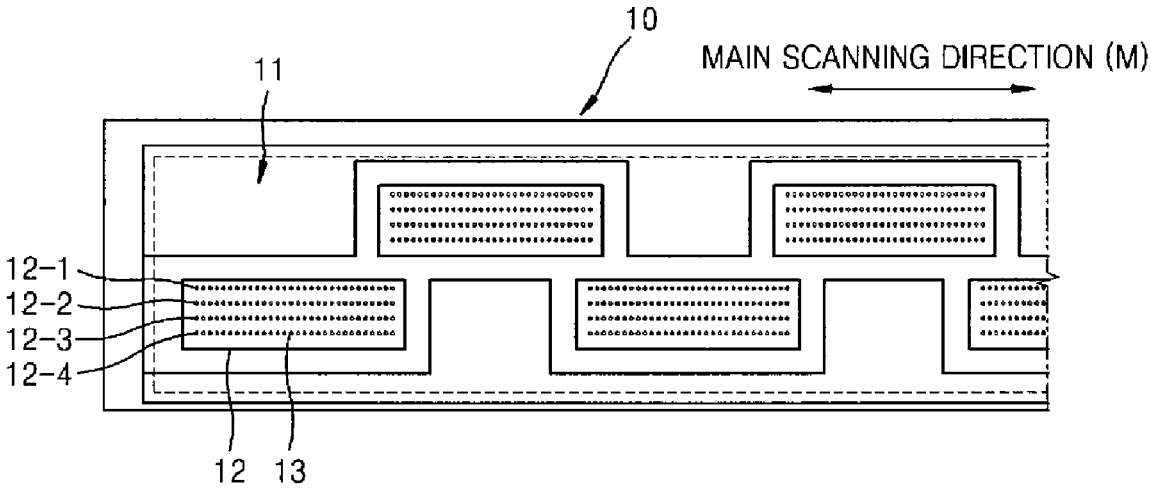
FIG. 2 is a view of a nozzle portion in the inkjet image forming apparatus of FIG. 1.

The inkjet head 10 is an array type inkjet head. In addition, the inkjet head 10 includes a nozzle portion 11, a length of which in a main scanning direction (M) is at least the same as a width of the paper P. Referring to FIG. 2, the nozzle portion 11 includes a plurality of nozzle plates 12 that are arranged in a zigzag formation in the main scanning direction M. Each of the nozzle plates 12 includes a plurality of nozzles 13 to eject the ink. The nozzle plate 12 may include a plurality of nozzle rows 12-1, 12-2, 12-3, and 12-4. In addition, the nozzle rows 12-1, 12-2, 12-3, and 12-4 may eject ink of the same color or may eject ink of different colors with respect to each other (for example, inks of cyan, magenta, yellow, and black colors). FIG. 2 illustrates an example of the nozzle portion 11, and the present general inventive concept is not limited to the example of the nozzle portion 11 of FIG. 2. Although it is not illustrated in the drawings, the inkjet head 10 includes a chamber having a discharge unit to connect to the nozzle and to provide a pressure to discharge the ink (for example, a piezoelectric device or a heater), and a flowing path to provide the chamber with the ink. The chamber, the discharge unit, and the flowing path are well known to those skilled in the art, and thus, detailed descriptions are omitted.

A platen 60 faces the nozzle portion 11 to support a rear surface of the paper P and to form a paper conveying path 100. The platen 60 is positioned so that the nozzle portion 11 of the inkjet head 10 maintains a predetermined distance, for example, 0.5-2 mm, from the paper P. A discharge unit 30 to discharge the paper P, on which the image is printed, is installed on an outlet side of the inkjet head 10.

If the nozzle portion 11 is exposed to air during a time in which a printing operation is not being performed, ink droplets around the nozzle portion 11 may be hardened, and impurities such as fine dust in the air can become attached to the nozzle portion 11. The hardened ink or the impurities that become attached to the nozzle portion 11 may change the ink injecting direction, and degrade the printing quality. In addition, when a printing operation is not being performed, the ink in the nozzle portion 11 is continuously evaporated and hardened, and thus, the nozzle portion 11 may become completely clogged by the hardened ink. Since the inkjet head 10 prints the image at a fixed position, if some of the nozzles 13 become clogged, a white line appears in the printed image at a portion corresponding to the clogged nozzle.

The nozzle portion 11 should maintain an optimal condition to perform the printing operation while realizing a high printing quality. To do this, maintenance operations such as a preliminary spitting process, a wiping process, and a capping operation are performed. If the printing operation is not performed for a predetermined period of time or if there is a nozzle 13 that is not used for a predetermined period of time during the printing operation, the ink in the nozzle 13 and around the nozzle 13 becomes dried and the viscosity of the ink increases, and thus, a defective ejection operation may occur. The preliminary spitting is an operation of spitting the ink a few times per a predetermined time period in order to remove the ink in which the viscosity has increased. In the wiping process, a surface of the nozzle portion 11 is wiped in order to remove the hardened ink and impurities around the nozzle 13. The capping process is performed in order to separate the nozzle portion 11 from the air around the nozzle 13 and to prevent the nozzle 13 from being dried. This is done by capping the nozzle portion 11 when the printing operation is not being performed for a predetermined period of time.

Figure 3:
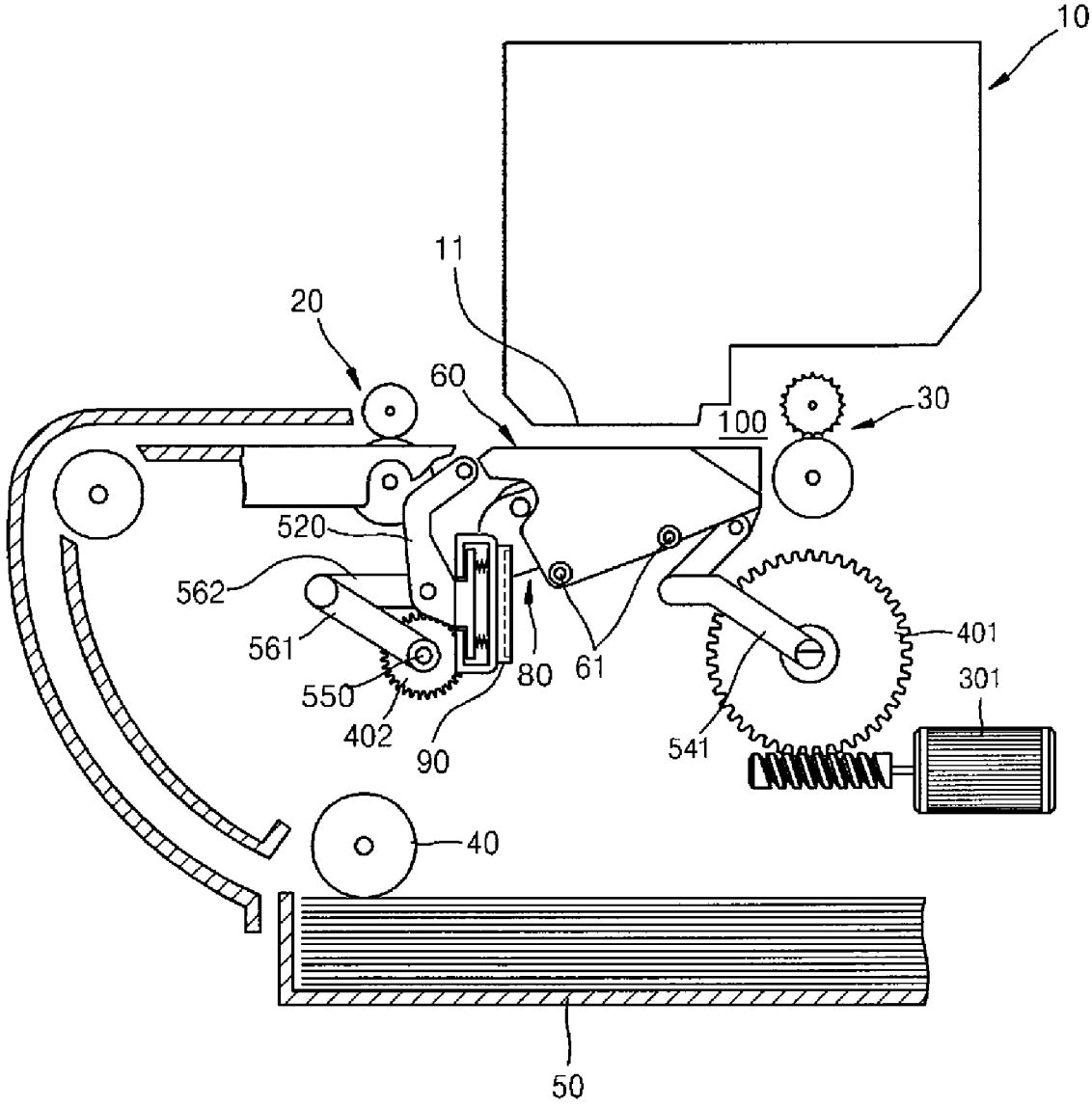
FIG. 3 is a block diagram of a device to provide maintenance in the image forming apparatus of FIG. 1.

FIG. 3 is a block diagram of a device to provide maintenance in the image forming apparatus of FIG. 1. Referring to FIG. 3, to maintain the nozzle portion 11, the inkjet image forming apparatus includes a cap member 90 to cap the nozzle portion 11 to isolate the nozzle portion 11 from the outer air, and a wiping unit 80 to clean the nozzle portion 11. In the image forming apparatus according to the present embodiment as illustrated in FIGS. 1-3, the platen 60 can move between a printing position forming the paper conveying path 100 and a maintenance position separated from the printing position in the sub-scanning direction S. The cap member 90 caps/uncaps the nozzle portion 11 in a state where the platen 60 is located at the maintenance position. In addition, in the image forming apparatus of the present embodiment, the wiping unit 80 is connected to the platen 60 to clean the nozzle portion 11 when the platen 60 moves, in particular, during an interval in which the platen 60 moves from the maintenance position toward the printing position.

Figure 4:
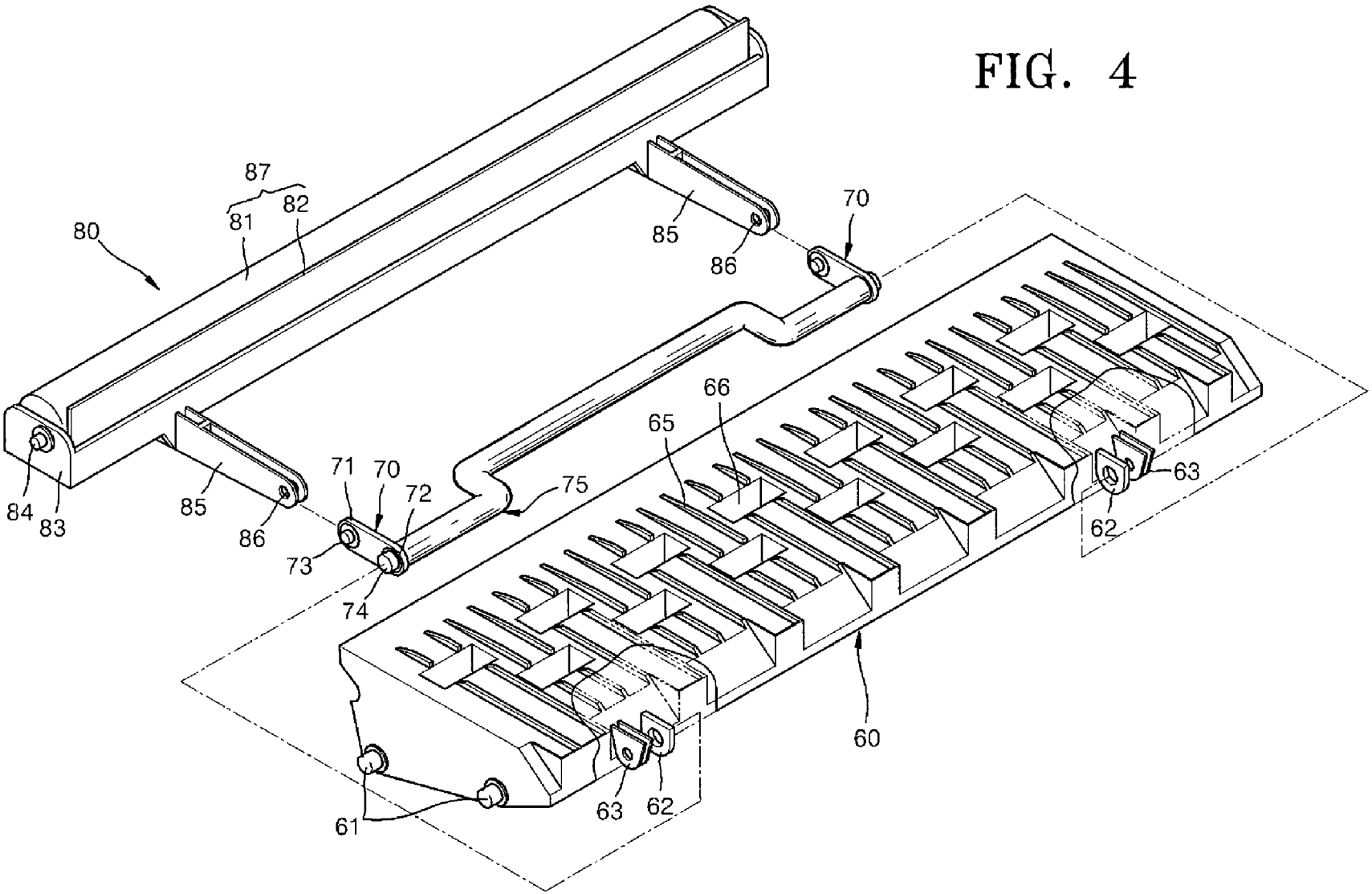
FIG. 4 is a detailed exploded perspective view of a platen and a wiping unit in the image forming apparatus of FIG. 1, according to an embodiment of the present general inventive concept.
Figure 5:
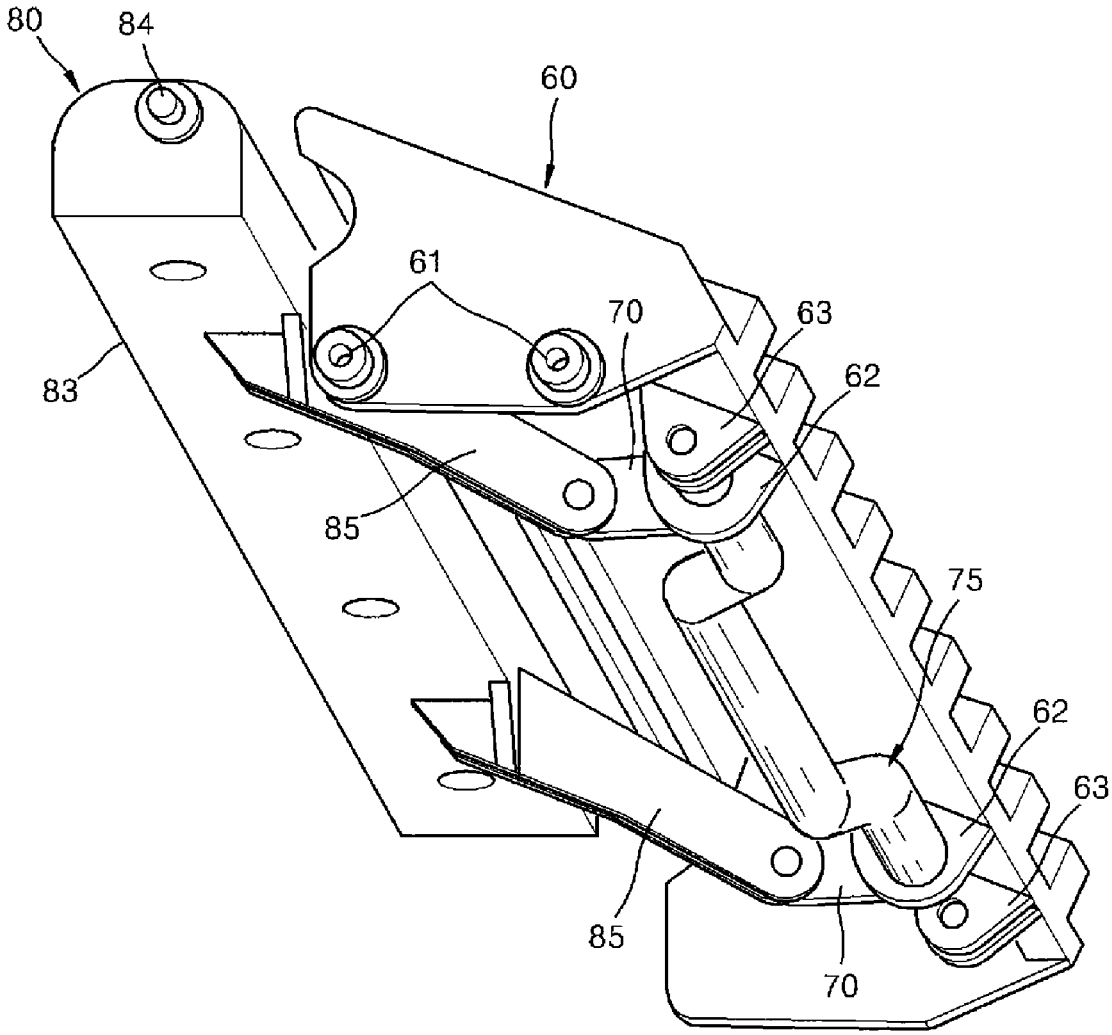
FIG. 5 is a detailed perspective view of the platen and the wiping unit of FIG. 4.

Referring to FIGS. 4 and 5, a wiper 87 to clean the nozzle portion 11 is installed on a holder 83. The wiping unit 80 includes a wiping roller 81, a wiping blade 82, or one of the two as the wiper 87, as illustrated in FIG. 4. The wiping roller 81 may be formed of a material that can absorb the ink, such as a sponge. The wiping blade 82 may be formed of a material having flexibility, such as rubber. The holder 83 includes a cam follower 84. In addition, the holder 83 includes a pair of supporting arms 85, and each of the supporting arms 85 includes a first insertion hole 86 on an end portion thereof.

A pair of link arms 70 are rotatably connected to the platen 60 and the wiping unit 80. A first boss 73 and a second boss 74 are formed on a first end portion 71 and a second end portion 72 of the link arm 70, respectively. The platen 60 includes a second insertion hole 62. The first and second bosses 73 and 74 are inserted into the first and second insertion holes 86 and 62, respectively. The pair of link arms 70 can be connected to each other by a connection member 75.

Figure 6:
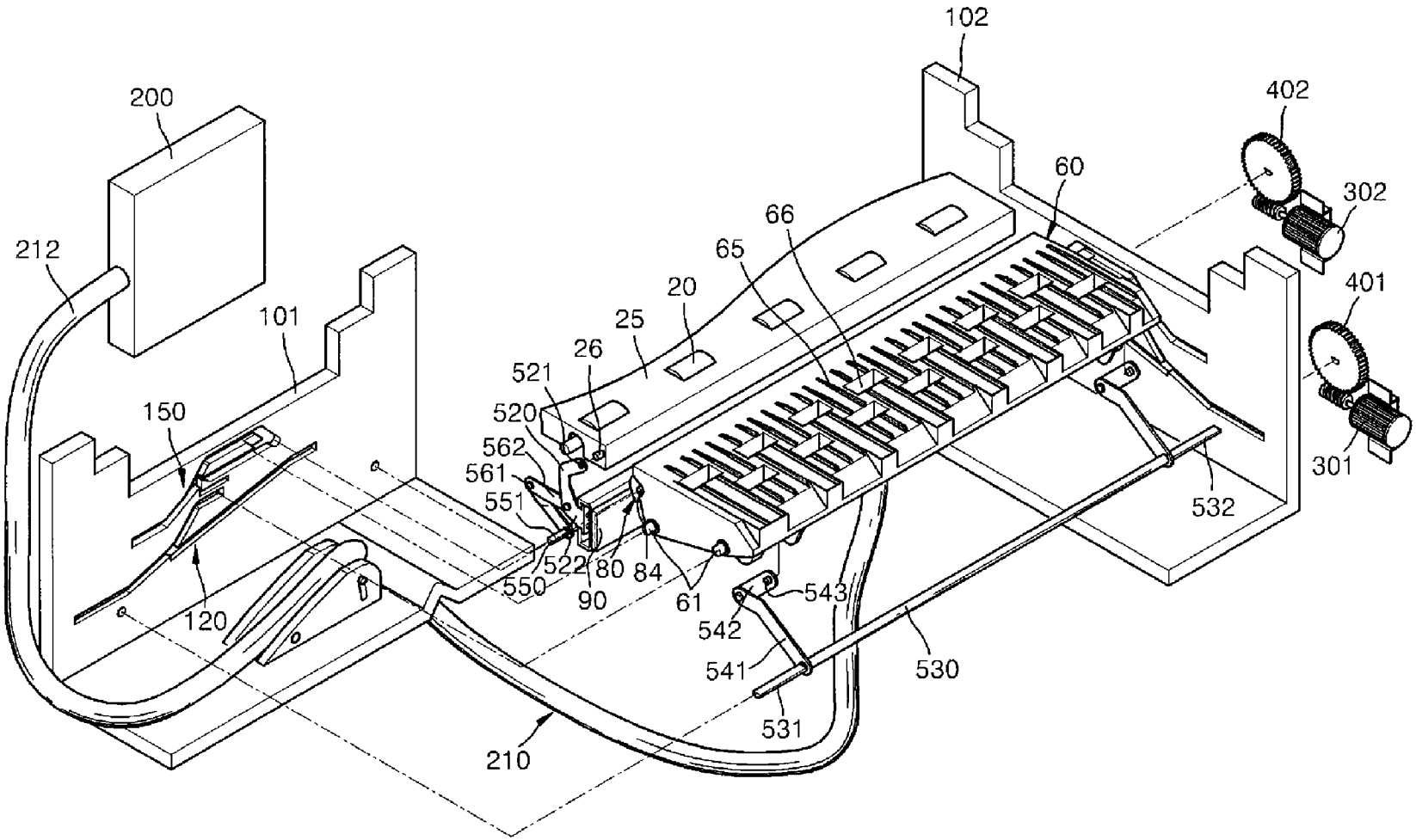
FIG. 6 is an exploded perspective view of the maintenance apparatus of FIG. 3.

Referring to FIG. 6, the platen 60 is coupled to side walls 101 and 102. The side walls 101 and 102 respectively include guide slots 120 illustrated in FIG. 7. Protrusions (61 of FIG. 4) are formed on both sides of the platen 60. The protrusions 61 are inserted into the guide slots 120. The platen 60 moves to the printing position or the maintenance position along the guide slots 120. Each of the guide slots 120 includes parallel sections 121 that are parallel to the paper conveying path 100, and a slant section 122 that inclines downward. The slant section 122 guides the platen 60 under the discharge unit 30 so that the platen 60 and the discharge unit 30 do not interfere with each other when the platen 60 moves to the maintenance position. A first shaft 530 (see, for example, FIG. 6) is rotatably supported by the side walls 101 and 102. D-cut portions 531 and 532 are formed on both ends of the first shaft 530. A pair of first levers 541 are coupled to the D-cut portions 531 and 532 of the first shaft 530, and are respectively connected to a pair of second levers 542 to be rotatable. Third bosses 543 are disposed on end portions of the second levers 542. The third bosses 543 are inserted into third insertion holes 63 (FIGS. 4 and 5) formed on the platen 60. A gear 401 is coupled to the D-cut portion 532. A maintenance motor 301 rotates the gear 401 to move the platen 60 to the printing position and to the maintenance position.

Figure 7:
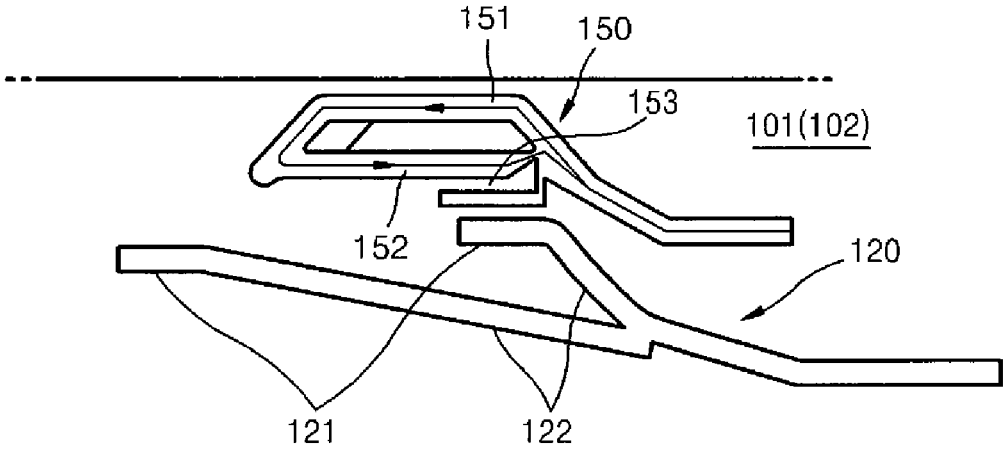
FIG. 7 is a detailed view of a guide slot and a wiping trace illustrated in FIG. 6.

Referring to FIG. 6, a wiping trace 150 is formed on the side walls 101 and 102. The cam follower 84 of the wiping unit 80 is coupled to the wiping trace 150. Referring to FIG. 7, the wiping trace 150 includes a wiping section 151 that guides the wiping unit 80 so that the wiper 87 can contact the nozzle portion 11 when the platen 60 moves from the maintenance position to the printing position. The wiping trace 150 further includes a returning section 152 that guides the wiping unit 80 so that the wiper 87 does not contact the nozzle portion 11 when the platen 60 moves from the printing position to the maintenance position. An elastic arm 153 performs as a latch that blocks the cam follower 84 from being inserted into the returning section 152 when the platen 60 moves from the maintenance position to the printing position. The elastic arm 153 allows the cam follower 84 to enter the wiping section 151 after passing through the returning section 152 when the platen 60 moves from the printing position to the maintenance position.

Referring to FIGS. 3 and 6, a cap arm 520 is installed on a guide member 25, which guides the paper under the nozzle portion 11, to be rotatable. An end of the cap arm 520 is coupled to a rotary shaft 26 formed on the guide member 25. The cap member 90 is installed on the other end 522 of the cap arm 520. A second shaft 550 is rotatably supported by the side walls 101 and 102. D-cut portions 551 are disposed on both ends of the second shaft 550. A pair of first cap driving arms 561 are coupled to the D-cut portions 551 of the second shaft 550. In addition, the pair of the first cap driving arms 561 are rotatably connected to a pair of second cap driving arms 562 that are rotatably connected to the cap arm 520. A gear 402 is coupled to the D-cut portion 551 of the second shaft 550. A cap motor 302 rotates the gear 402 to move the cap member 90 to a capping position (refer to FIG. 8) and to an uncapping position (refer to FIG. 3).

Hereinafter, maintenance operations using the above structure will be described as follows.

Referring to FIG. 3, the platen 60 is located at the printing position and supports the rear surface of the paper P. The cap member 90 is located at the uncapping position. The protrusion 61 of the platen 60 is supported by the parallel sections 121 of the guide slot 120 (see FIGS. 6 and 7). Therefore, even if the position accuracy of the platen 60 at the printing position is low, a distance between the nozzle portion 11 and the upper surface of the paper P can be maintained accurately as long as the protrusion 61 is supported by the parallel section 121. The wiping unit 80 is disposed under the platen 60. The cam follower 84 of the wiping unit 80 is located at the returning section 152, and the wiper 87 is separated from the nozzle portion 11. In this state, a sheet of paper P is picked from the paper cassette 50 using the pickup roller 40, and then the conveying unit 20 conveys the picked-up paper P along the paper conveying path 100. The inkjet head 10 injects the ink onto the paper P to print an image thereon. The discharge unit 30 discharges the paper P, on which the image is printed. Before printing the image or after performing a printing operation onto a few sheets of paper P, the preliminary spitting operation is performed when no paper P exists on the paper conveying path 100. The preliminarily spitted ink drops onto the plurality of receiving portions 66 formed on the platen 60. Therefore, even if the paper P is conveyed after performing the preliminary spitting operation, the rear surface of the paper P is not contaminated by the ink that is received in the receiving portions 66.

When the maintenance motor 301 rotates the gear 401, the first shaft 530 and the first and second levers 541 and 542, which are connected to the first shaft 530, are rotated. The platen 60 moves in the sub-scanning direction S. The protrusions 61 of the platen 60 are guided by the slant section 122 toward the maintenance position when they are out of the parallel sections 121. The cam follower 84 of the wiping unit 80 is guided by the returning section 152, and thus, the wiper 87 does not contact the nozzle portion 11.

Figure 8:
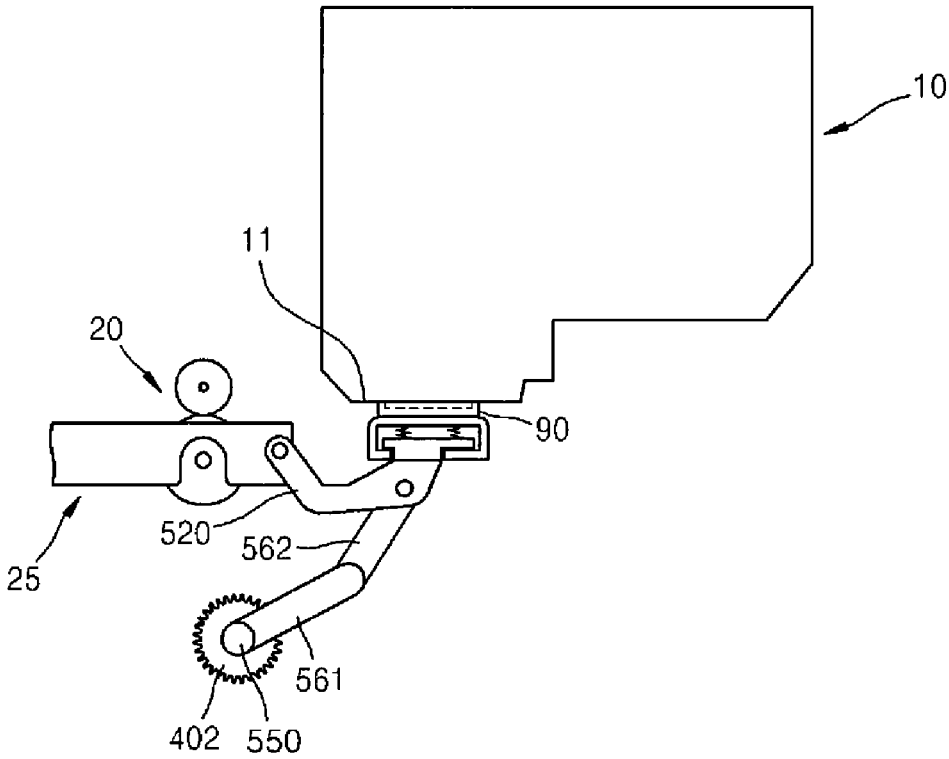
FIG. 8 is a side view of a nozzle portion that is capped.

If a printing command is not input, the cap motor 302 drives to move the cap member 90 to the capping position as illustrated in FIG. 8 and to cap the nozzle portion 11, and waits until the printing command is input. When the printing command is input, cap member 90 is moved to the uncapping position as illustrated in FIG. 3 using the cap motor 302. Then, the maintenance motor 301 rotates the gear 401 in order to move the platen 60 to the printing position, at which time the platen 60 and the wiping unit 80 start to move to the printing position. At this time, the elastic arm 153 blocks the cam follower 84 from entering the returning section 152. Therefore, the wiping unit 80 is guided by the wiping section 151. When the platen 60 moves to the printing position, the wiper 87 contacts the nozzle portion 11 to clean the impurities on the nozzle portion 11. When the wiping operation is finished, the platen 60 reaches the printing position as illustrated in FIG. 3.

Figure 9:
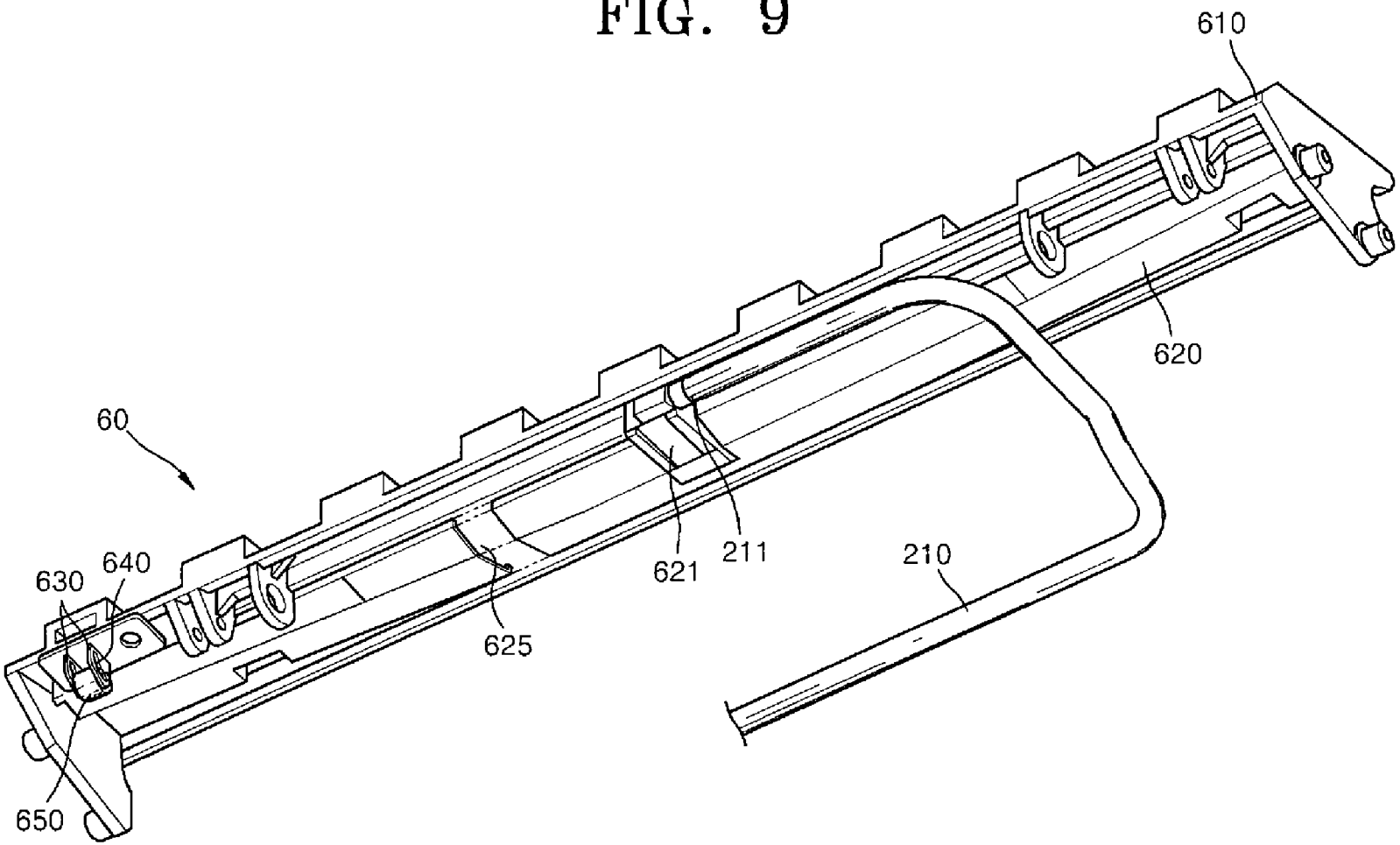
FIG. 9 is a rear perspective view of the platen illustrating a pumping unit.

Referring to FIGS. 4, 6, and 9, the platen 60 includes an upper cover 610 and a lower cover 620. The upper cover 610 includes a plurality of ribs 65 supporting the rear surface of the paper P. In addition, the upper cover 610 includes penetration portions 66, through which the preliminarily spitted ink passes. The penetration portions 66 correspond to the plurality of nozzle plates 12 illustrated in FIG. 2. The lower cover 620 is coupled to the upper cover 610 and includes a receiving portion 625, in which the waste ink is received. The lower cover 620 includes a discharge portion 621 to discharge the waste ink. A portion of the lower cover 620 where the discharge portion 621 is formed may be inclined downward so that the waste ink can be collected at the discharge portion 621. The waste ink can be generated during the printing operation as well as during the preliminary spitting operation. If a borderless printing operation, which prints an image on an entire region on the paper without a margin, is performed, some of the ink discharged from the nozzle portion 11 may exceed edges of the paper. The ink exceeding the edges of the paper is also received in the receiving portion 625 after passing through the penetration portions 66.

Figure 10:
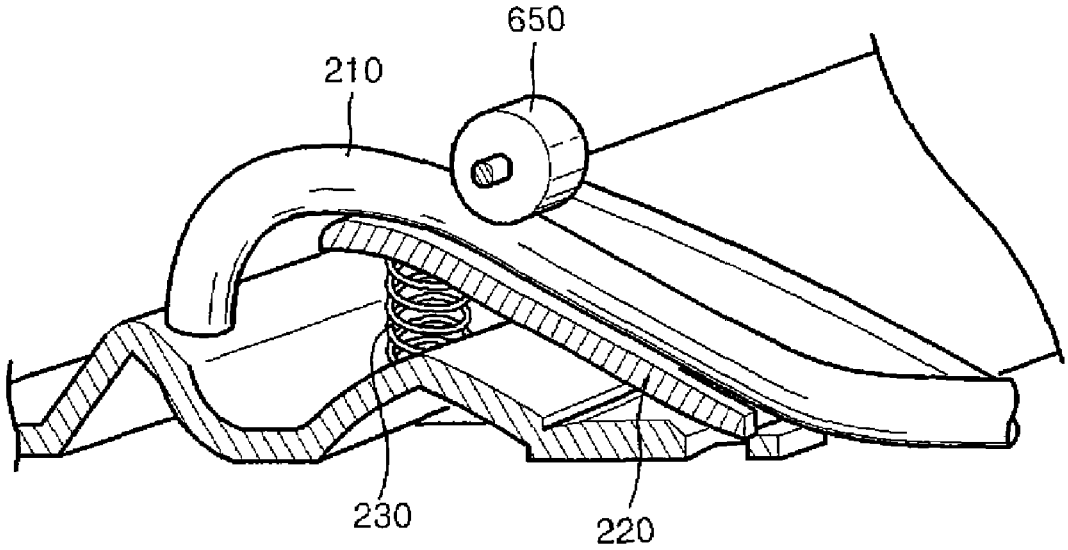
FIG. 10 is a perspective view of a supporting member and an elastic member in the maintenance apparatus.

The image forming apparatus of the present embodiment includes a pumping unit to pump the waste ink into the waste ink container 200 by being associated with the moving operation of the platen 60. Referring to FIGS. 6 and 9, a pressing member 650 is installed on the platen 60. An end portion 211 of a waste ink tube 210 is connected to the discharge portion 621 of the paten 60, and the other end 212 of the waste ink tube 210 is connected to the waste ink container 200. The waste ink tube 210 may be formed of an elastic material such as rubber. A part of the waste ink tube 210 is supported by a supporting member 220 that faces the pressing member 650 as illustrated in FIG. 10. Referring to FIG. 10, the supporting member 220 can be supported elastically by the elastic member 230. A contacting pressure between the pressing member 650 and the waste ink tube 210 can be controlled by controlling the elastic force of the elastic member 230. In addition, the elastic member 230 prevents the pressing member 650 from excessively pressing the waste ink tube 210 and the maintenance motor 301 that moves the platen 60 from receiving excessive loads.

Since the platen 60 reciprocates along the guide slot 120, and the structure of the pumping unit becomes complex in order to pump the waste ink when the platen 60 moves from the printing position to the maintenance position, and vice versa, according to the image forming apparatus of the present general inventive concept, the waste ink is pumped only when the platen 60 moves from the printing position to the maintenance position or when the platen 60 moves from the maintenance position to the printing position. Thus, the pumping unit includes a pumping trace 640 to guide the pressing member 650 to push on the waste ink tube 210 when the platen 60 moves from the printing position to the maintenance position, or vice versa, and to release the pressure applied to the waste ink tube 210 when the platen 60 moves in the opposite direction. Hereinafter, the pumping unit pumping the waste ink into the waste ink container 210 when the platen 60 moves from the printing position to the maintenance position is described below.

Figure 11:
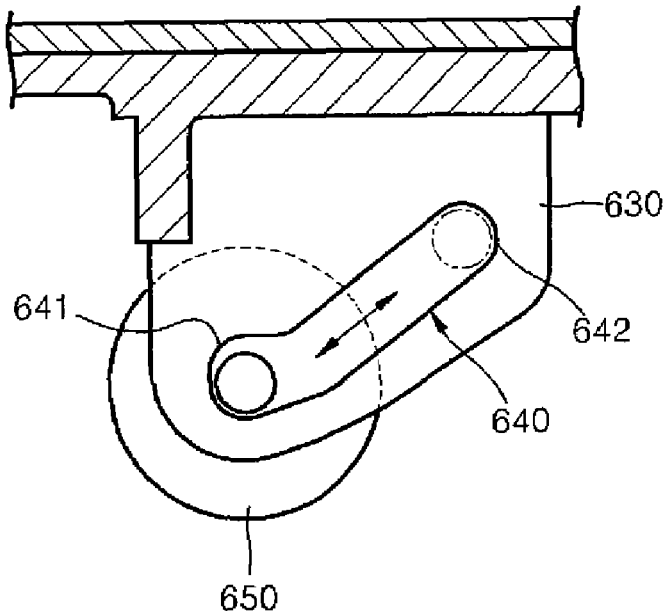
FIG. 11 is a detailed side view of a pumping trace.

Referring to FIGS. 8 and 11, the platen 60 includes a pair of supporting portions 630. Pumping traces 640 are formed on the pair of supporting portions 630. The pumping trace 640 is formed as a slot extending in the sub-scanning direction S. The pumping trace 640 includes a first end portion 641 and a second end portion 642. The second end portion 642 is separated from the supporting member 220 farther than the first end portion 641 is. In the present embodiment, a roller type pressing member 650 is used. The pressing member 650 is rotatably supported by the pumping trace 640. When the platen 60 moves from the printing position to the maintenance position, the pressing member 650 is located at the first end portion 641. When the platen 60 moves from the maintenance position to the printing position, the pressing member 650 is located at the second end portion 642.

The pumping operation using the above structure will be described as follows.

Figure 12A:
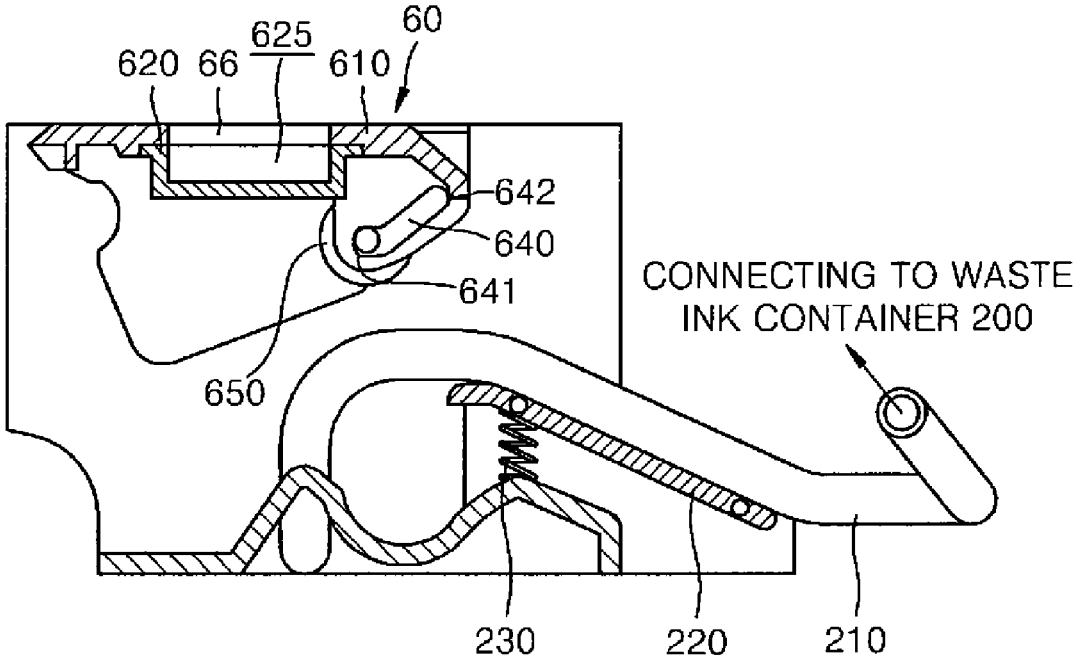
FIGS. 12A through 12F are views illustrating a pumping operations in the maintenance apparatus.
Figure 12B:
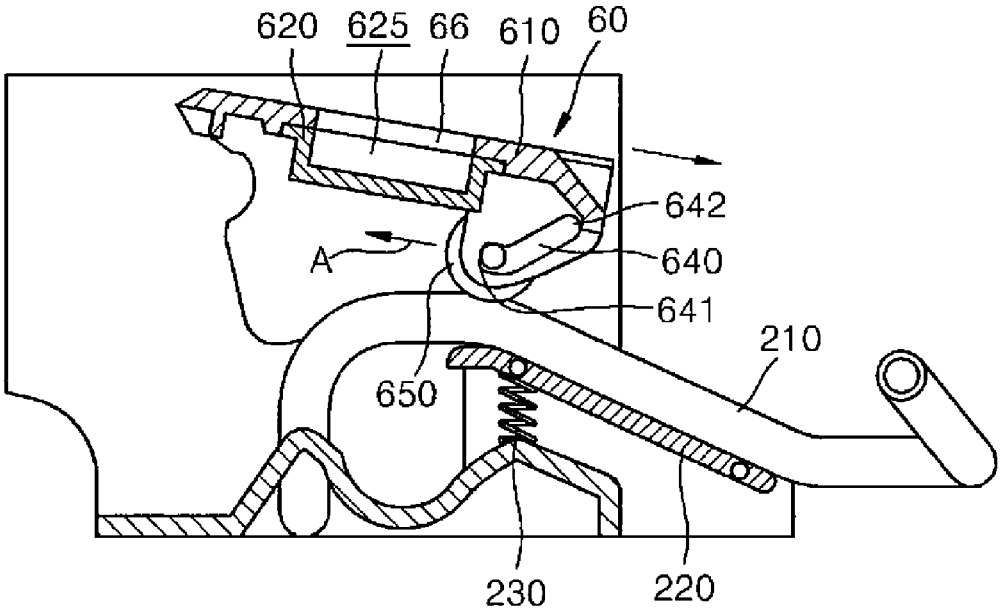
Figure 12C:
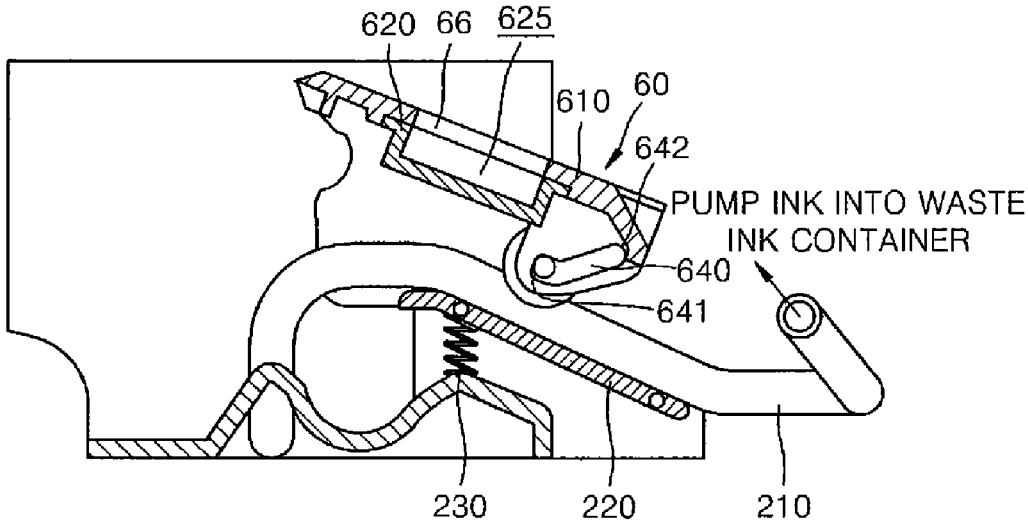
Figure 12D:
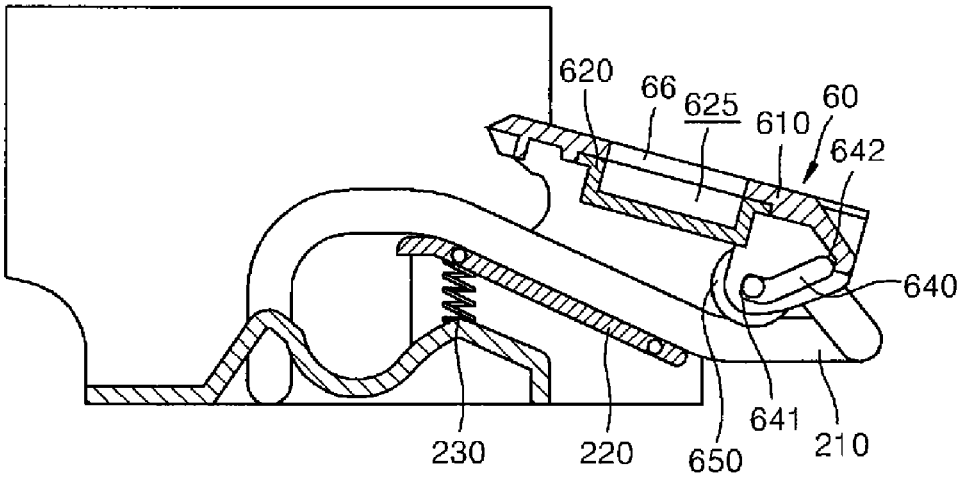
Figure 12E:
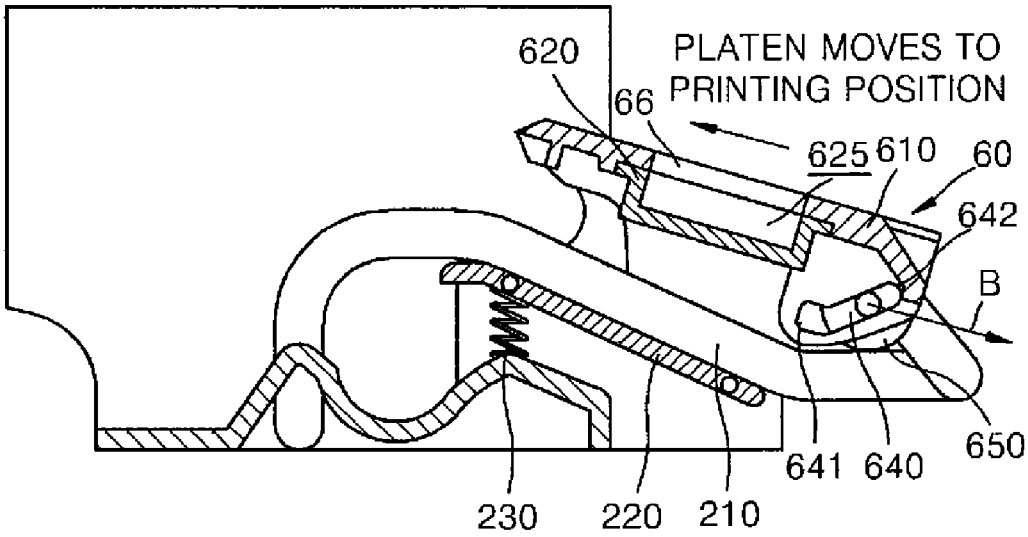
Figure 12F:
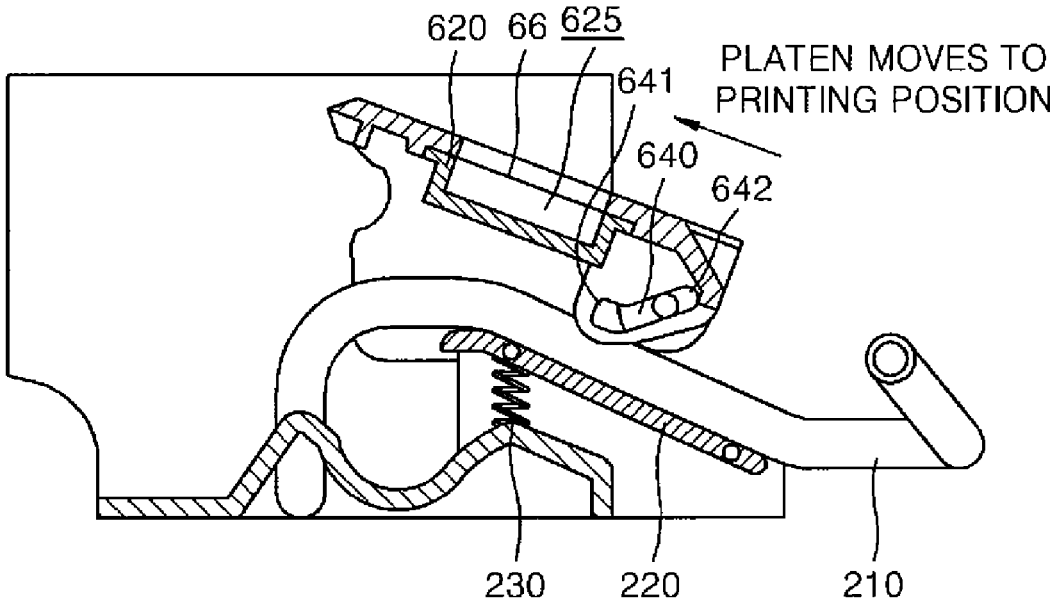

Referring to FIG. 12A, the preliminary spitting process is performed in a state where the platen 60 is located at the printing position. Waste ink is collected into the receiving portion 625 of the platen 60. The maintenance motor 301 is driven to pump the waste ink, and the platen 60 starts to move toward the maintenance position. Referring to FIG. 12B, when the pressing member 650 contacts the waste ink tube 210, the pressing member 650 is pushed to a direction A opposite to the moving direction of the platen 60. When the pressing member 650 is located at the first end portion 641 of the pumping trace 640, the pressing member 641 is not pushed to the direction A any further. Referring to FIG. 12C, the pressing member 650 moves while pushing against the waste ink tube 210. The ink in the waste ink tube 210 is pushed toward the waste ink container 200. Referring to FIG. 12D, when the platen 60 reaches the maintenance position, the maintenance motor 301 rotates in an opposite direction, and then, the platen 60 starts to move to the printing position. Then, the pressing member 650 is pushed in a direction B opposite to the moving direction of the platen 60, as illustrated in FIG. 12E. The pressing member 650 is moved toward the second end portion 642 of the pumping trace 640. Therefore, when the platen 60 moves from the maintenance position to the printing position, the pressure of the pressing member 650 onto the waste ink tube 210 is released, and thus, the waste ink is not pumped, as illustrated in FIG. 12F. The processes illustrated in FIGS. 12A through 12F are repeated to pump the waste ink in the receiving portion 625 into the waste ink container 200.

According to the inkjet image forming apparatus of the present general inventive concept, since the pumping unit is driven with the platen when the platen moves, an additional motor to pump the waste ink is not required. The supporting member, on which the waste ink tube is installed, is elastically supported by the elastic member. Therefore, the pumping pressure can be controlled by controlling the elastic force of the elastic member, and thereby, preventing the maintenance motor that moves the platen from being applied excessive load due to the pressure of the pressing member onto the waste ink tube. In addition, since the pressing member formed as a roller that is elastically supported by the pumping trance is used, the pumping operation can be performed sufficiently.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An inkjet image forming apparatus comprising:

an inkjet head including a nozzle portion having a length in a main scanning direction that is at least the same as a width of a paper to be fed;

a platen to move between a printing position facing the nozzle portion and supporting a rear surface of paper and a maintenance position that is apart from the printing position in a sub-scanning direction, and including a receiving portion to receive waste ink;

a waste ink container; and a pumping unit to operate by linking with a moving operation of the platen to pump the waste ink from the receiving portion to the waste ink container.

2. The inkjet image forming apparatus of claim 1, wherein the pumping unit comprises:

a waste ink tube to connect the receiving portion to the waste ink container; and a pressing member installed on the platen, wherein the pressing member moves while pushing against the waste ink tube when the platen moves to pump the waste ink to the waste ink container.

3. The inkjet image forming apparatus of claim 2, further comprising:

a pumping trace to guide the pressing member to push the waste ink tube during one of a process of moving the platen from the printing position to the maintenance position and a process of moving the platen in an opposite direction, and to guide the pressing member to release the pressure applied to the waste ink tube during the other process.

4. The inkjet image forming apparatus of claim 3, further comprising:

a supporting member to face the pressing member and to support the waste ink tube; and an elastic member to elastically support the supporting member.

5. The inkjet image forming apparatus of claim 4, wherein the pressing member is formed as a roller and is installed on the platen to be rotatable.

6. The inkjet image forming apparatus of claim 1, wherein the pumping unit pumps the waste ink when the platen moves from the printing position to the maintenance position.

7. The inkjet image forming apparatus of claim 6, wherein the pumping unit comprises:

a pressing roller installed on the platen; and a pumping trace, which is a slot installed on the platen to rotatably support the pressing roller, including a first end portion to guide the pressing roller to push the waste ink tube when the platen moves from the printing position to the maintenance position, and a second end portion to guide the pressing roller to release the pressure applied onto the waste ink tube when the platen moves to the printing position.

8. The inkjet image forming apparatus of claim 7, wherein the pumping unit further comprises:

a supporting member to support the waste ink tube; and an elastic member to elastically support the supporting member.

9. An inkjet image forming apparatus, comprising;

an inkjet head to eject ink onto an image recording medium during a printing operation and to eject ink to clean nozzles of the inkjet head during a maintenance operation, the inkjet head being at least as wide as a width of the image recording medium;

a platen movably disposed below the inkjet head to support the image recording medium when ink is being ejected thereon, the platen being movable between a printing position facing the inkjet head and a maintenance position disposed away from the inkjet head, the platen including a wiping unit to wipe the inkjet head when the platen is being moved between the maintenance position and the printing position and an ink receiving portion to receive excess ink not ejected onto the image recording medium; and a pumping unit to pump ink out of the ink receiving portion, the pumping unit including a waste ink tube extending to the ink receiving portion and a pressing device to press the waste ink tube to force ink to the pumping unit and away from the ink receiving portion when the platen is being moved between the printing position and the maintenance position.

10. The inkjet image forming apparatus of claim 9, wherein the pressing device comprises:

a supporting member on which the waste ink tube rests; and a pressing member installed on the platen to press the waste ink tube against the supporting member when the platen moves between the printing position and the maintenance position.

11. The inkjet image forming apparatus of claim 10, wherein the platen comprises a pair of supporting portions at opposite ends thereof including corresponding pumping traces formed therein in which the pressing member is guided to press the waste ink tube.

12. The inkjet image forming apparatus of claim 11, wherein the pumping traces comprise a first end portion and a second end portion, the first end portion being positioned closer to the supporting portion than the second end portion such that when the platen moves from the printing position to the maintenance position, the pressing member is guided to the first end portion to press the waste ink tube against the supporting portion to create a pumping action, and when the platen moves from the maintenance position to the printing position the pressing member is guided to the second end portion and does not press the waste ink tube.

13. The inkjet image forming apparatus of claim 12, wherein the pressing member is a roller type pressing member rotatably supported by the pumping traces at each side thereof.

14. The inkjet image forming apparatus of claim 11, wherein the pressing device further comprises:

an elastic member to provide a bias on the supporting member in a direction opposite to the pressing force of the pressing member to prevent to pressing member from excessively pressing the waste ink tube.

15. The inkjet image forming apparatus of claim 10, wherein the waste ink tube is formed of an elastic material.

16. A method of collecting waste ink from an inkjet image forming apparatus, comprising:

catching ink spitted from an inkjet head into an ink receiving portion of a platen when cleaning nozzles of the inkjet head eject ink; and pressing a tube connected between the ink receiving portion and a waste ink container with a member of the platen when moving the platen between the a printing position and a maintenance position to create a pumping force to move the ink from the ink receiving portion to the waste ink container.

* * * * *